US011635715B2

(12) United States Patent
Adachi et al.

(10) Patent No.: US 11,635,715 B2
(45) Date of Patent: Apr. 25, 2023

(54) PLANAR HEATER, FIXING DEVICE, IMAGE FORMING APPARATUS, AND METHOD OF MANUFACTURING PLANAR HEATER

(71) Applicants: Tomoya Adachi, Kanagawa (JP); Yuusuke Furuichi, Kanagawa (JP); Yukimichi Someya, Saitama (JP)

(72) Inventors: Tomoya Adachi, Kanagawa (JP); Yuusuke Furuichi, Kanagawa (JP); Yukimichi Someya, Saitama (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/545,353

(22) Filed: Dec. 8, 2021

(65) Prior Publication Data

US 2022/0283530 A1 Sep. 8, 2022

(30) Foreign Application Priority Data

Mar. 2, 2021 (JP) ..... JP2021-032600

(51) Int. Cl.
*G03G 15/20* (2006.01)
*H05B 3/26* (2006.01)
*G03G 15/00* (2006.01)

(52) U.S. Cl.
CPC ..... *G03G 15/2053* (2013.01); *G03G 15/80* (2013.01); *H05B 3/26* (2013.01); *H05B 2203/016* (2013.01); *H05B 2203/017* (2013.01)

(58) Field of Classification Search
None
See application file for complete search history.

(56) References Cited

U.S. PATENT DOCUMENTS

2017/0363998 A1* 12/2017 Takagi ..... G03G 15/2053
2018/0305150 A1* 10/2018 Sato ..... G06K 19/06037
2019/0179242 A1 6/2019 Adachi et al.
2019/0196374 A1 6/2019 Adachi et al.
2019/0278206 A1 9/2019 Adachi et al.
2019/0286027 A1 9/2019 Someya et al.
2019/0286029 A1 9/2019 Adachi et al.
2020/0033766 A1 1/2020 Hase et al.
2020/0033767 A1 1/2020 Adachi et al.
(Continued)

FOREIGN PATENT DOCUMENTS

DE 202018006647 U1 * 11/2021 ..... B32B 13/12
JP 8-213495 8/1996
(Continued)

OTHER PUBLICATIONS

Translation of DE—202018006647-U1.*

*Primary Examiner* — Arlene Heredia
(74) *Attorney, Agent, or Firm* — Harness, Dickey & Pierce, P.L.C.

(57) ABSTRACT

A planar heater includes a base, a resister pattern, a conductor pattern, a power supply electrode, and a base pattern. The base includes a surface portion made of an insulative material. The resistor pattern is on the base. The conductor pattern is on the base and electrically coupled to the resistor pattern. The power supply electrode is electrically coupled to the conductor pattern. The base pattern is on the base and made of a material different from a material of the surface portion of the base to print visible identification information.

20 Claims, 5 Drawing Sheets

(56) References Cited

U.S. PATENT DOCUMENTS

| | | | |
|---|---|---|---|
| 2020/0033775 | A1 | 1/2020 | Inoue et al. |
| 2020/0249601 | A1 | 8/2020 | Inoue et al. |
| 2020/0401067 | A1 | 12/2020 | Samei et al. |

FOREIGN PATENT DOCUMENTS

| | | |
|---|---|---|
| JP | 2005-338350 | 12/2005 |
| JP | 2013-043430 | 3/2013 |

* cited by examiner

PLANAR HEATER, FIXING DEVICE, IMAGE FORMING APPARATUS, AND METHOD OF MANUFACTURING PLANAR HEATER

CROSS-REFERENCE TO RELATED APPLICATION

This patent application is based on and claims priority pursuant to 35 U.S.C. § 119(a) to Japanese Patent Application No. 2021-032600, filed on Mar. 2, 2021 in the Japan Patent Office, the entire disclosure of which is incorporated by reference herein.

BACKGROUND

Technical Field

This disclosure relates to a planar heater including a resister pattern, a fixing device incorporating the planar heater, an image forming apparatus such as a copier, printer, facsimile machine, a multi-functional apparatus including at least two functions of the copier, printer, and facsimile machine, and a method of manufacturing a planar heater.

Related Art

One type of fixing device in an image forming apparatus such as a copier or a printer uses a planar heater (a resistive heat generator) as a heating device to heat a fixing belt.

Specifically, the fixing device includes a fixing belt (fixing sleeve), a pressure roller as a pressure rotator, and a planar heater (a resistive heat generator) that is pressed against the pressure roller via the fixing belt. As a driver drives and rotates the pressure roller, the fixing belt rotates in accordance with rotation of the pressure roller by friction therebetween generated at the fixing nip. As a sheet bearing a toner image is conveyed through the fixing nip, the fixing belt heated by the heater and the pressure roller fix the toner image on the sheet under heat and pressure. These parts are marked with a lot number or the like.

SUMMARY

This specification describes an improved planar heater that includes a base, a resister pattern, a conductor pattern, a power supply electrode, and a base pattern. The base includes a surface portion made of insulative material. The resistor pattern is on the base. The conductor pattern is on the base and electrically coupled to the resistor pattern. The power supply electrode is electrically coupled to the conductor pattern. The base pattern is on the base and made of a material different from a material of the surface portion of the base to print visible identification information.

This specification further describes an improved method of manufacturing a planar heater including following processes. One process is forming a resistor pattern and a conductor pattern electrically connected to the resistor pattern on a base including a surface portion made of an insulative material. The other process is forming, on the base, a power supply electrode electrically coupled to the conductor pattern and a base pattern made of a material different from a material of the surface portion of the base to print visible identification information.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
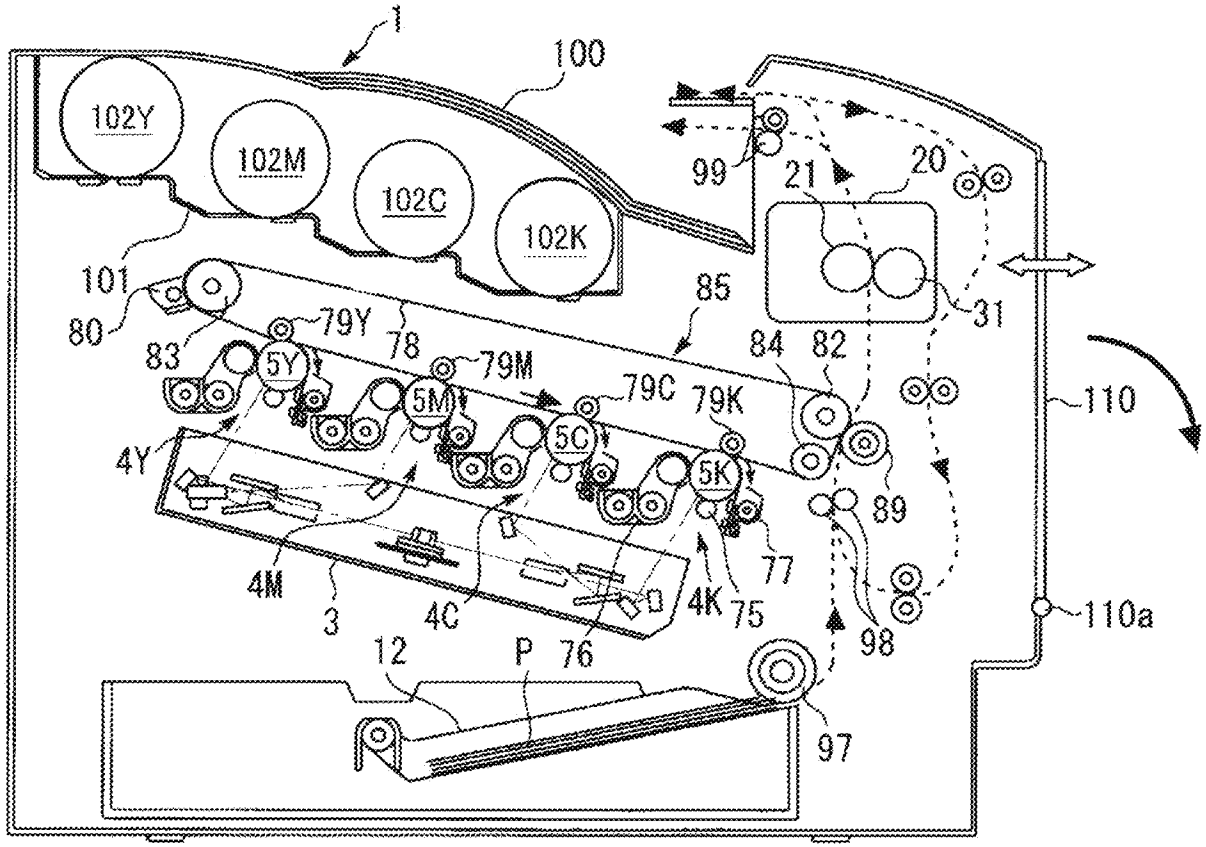
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

Embodiments of the present disclosure are described below with reference to drawings. Identical reference numerals are assigned to identical components or equivalents and a description of those components is simplified or omitted.

Initially, with reference to FIG. 1, a configuration and operation of an image forming apparatus 1 according to a present embodiment of the present disclosure is described below.

As illustrated in FIG. 1, the image forming apparatus 1 according to the present embodiment is a tandem-type color printer. The image forming apparatus 1 includes a bottle housing 101 in an upper portion of the image forming apparatus 1. The bottle housing 101 accommodates four toner bottles 102Y, 102M, 102C, and 102K containing fresh yellow, magenta, cyan, and black toners, respectively, and being detachably attached to the bottle housing 101 for replacement.

Under the bottle housing 101, an intermediate transfer unit 85 is disposed. Facing an intermediate transfer belt 78 of the intermediate transfer unit 85, image forming devices 4Y 4M, 4C, and 4K are arranged side by side to form toner images of yellow, magenta, cyan, and black, respectively.

The image forming devices 4Y, 4M, 4C, and 4K include photoconductor drums 5Y, 5M, 5C, and 5K, respectively. Each of the photoconductor drums 5Y, 5M, 5C, and 5K is surrounded by a charger 75, a developing device 76, a cleaner 77, a discharger, and the like. Image forming processes including a charging process, an exposure process, a developing process, a primary transfer process, and a cleaning process are performed on an outer circumferential surface of each of the photoconductor drums 5Y, 5M, 5C, and 5K, forming yellow, magenta, cyan, and black toner images on the photoconductor drums 5Y, 5M, 5C, and 5K, respectively.

A motor drives and rotates the photoconductor drums 5Y, 5M, 5C, and 5K clockwise in FIG. 1. The charger 75 disposed opposite each of the photoconductor drums 5Y, 5M, 5C, and 5K uniformly charges the outer circumferential surface thereof in the charging process.

After the charging process, the charged outer circumferential surface of each of the photoconductor drums 5Y, 5M, 5C, and 5K reaches an irradiation position at which an exposure device 3 irradiates and scans the photoconductor drums 5Y, 5M, 5C, and 5K with laser beams L, irradiating and scanning the photoconductor drums 5Y, 5M, 5C, and 5K with the laser beams L forms electrostatic latent images according to yellow, magenta, cyan, and black image data in the exposure process.

After the exposure process, the irradiated and scanned outer circumferential surface of each of the photoconductor drums 5Y, 5M, 5C, and 5K reaches a developing position at which the developing device 76 is disposed opposite each of the photoconductor drums 5Y, 5M, 5C, and 5K, and the developing device 76 develops the electrostatic latent image formed on the respective photoconductor drums 5Y, 5M, 5C, and 5K, thus forming yellow, magenta, cyan, and black toner images on the photoconductor drums 5Y, 5M, 5C, and 5K in the developing process.

After the developing process, the yellow, magenta, cyan, and black toner images formed on the photoconductor drums 5Y, 5M, 5C, and 5K reach primary transfer nips formed between the photoconductor drums 5Y, 5M, 5C, and 5K and the intermediate transfer belt 78 by four primary transfer bias rollers 79Y, 79M, 79C, and 79K pressed against the four photoconductor drums 5Y, 5M, 5C, and 5K via the intermediate transfer belt 78, respectively, and the yellow, magenta, cyan, and black toner images are primarily transferred onto the intermediate transfer belt 78 in a primary transfer process. After the primary transfer process, residual toner failed to be transferred onto the intermediate transfer belt 78 remains on the photoconductor drums 5Y, 5M, 5C, and 5K slightly.

After the primary transfer process, the residual toner on each of the photoconductor drums 5Y, 5M, 5C, and 5K reaches a cleaning position at which the cleaner 77 is disposed opposite each of the photoconductor drums 5Y, 5M, 5C, and 5K, and a cleaning blade of the cleaner 77 mechanically collects the residual toner from each of the photoconductor drums 5Y, 5M, 5C, and 5K in the cleaning process.

Finally; the cleaned outer circumferential surface of each of the photoconductor drums 5Y, 5M, 5C, and 5K reaches a discharging position at which the discharger is disposed opposite each of the photoconductor drums 5Y, 5M, 5C, and 5K, and the discharger eliminates residual potential from each of the photoconductor drums 5Y, 5M, 5C, and 5K.

Thus, a series of image forming processes performed on the photoconductor drums 5Y, 5M, 5C, and 5K is finished.

The yellow, magenta, cyan, and black toner images formed on the photoconductor drums 5Y, 5M, 5C, and 5K in the developing process are primarily transferred onto an outer circumferential surface of the intermediate transfer belt 78 such that the yellow, magenta, cyan, and black toner images are superimposed on a same position on the intermediate transfer belt 78. Thus, a color toner image is formed on the intermediate transfer belt 78.

The intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, and an intermediate transfer belt cleaner 80. The intermediate transfer belt 78 is stretched taut across and supported by the three rollers, that is, the secondary transfer backup roller 82, the cleaning backup roller 83, and the tension roller 84. One of the three rollers, that is, the secondary transfer backup roller 82 drives and rotates the intermediate transfer belt 78 in a rotation direction indicated by arrow in FIG. 1.

The four primary transfer bias rollers 79Y, 79M, 79C, and 79K sandwich the intermediate transfer belt 78 together with the four photoconductor drums 5Y, 5M, 5C, and 5K, respectively, thus forming the four primary transfer nips between the intermediate transfer belt 78 and the photoconductor drums 5Y, 5M, 5C, and 5K. Each of the primary transfer bias rollers 79Y, 79M, 79C, and 79K is applied with a primary transfer bias having a polarity opposite a polarity of electric charge of toner.

The intermediate transfer belt 78 is moved in the direction indicated by arrow in FIG. 1 and sequentially passes through the primary transfer nips formed by the primary transfer bias rollers 79Y, 79M, 79C, and 79K. The yellow, magenta, cyan, and black toner images on the photoconductor drums 5Y, 5M, 5C, and 5K are primarily transferred to and superimposed on the intermediate transfer belt 78, thereby forming the color toner image.

Subsequently, the intermediate transfer belt 78 carrying the color toner image reaches a position opposite the secondary transfer roller 89. At the position, the secondary transfer backup roller 82 and the secondary transfer roller 89 press against each other via the intermediate transfer belt 78, and the contact portion therebetween is hereinafter referred to as a secondary transfer nip. The four-color toner image formed on the intermediate transfer belt 78 is transferred onto the sheet P conveyed to the position of the secondary transfer nip. At this time, untransferred toner that is not transferred onto the sheet P remains on the surface of the intermediate transfer belt 78. The intermediate transfer belt 78 reaches a position opposite the intermediate transfer belt cleaner 80. At the position, the intermediate transfer belt cleaner 80 collects the untransferred toner from the intermediate transfer belt 78.

Thus, a sequence of image forming processes performed on the intermediate transfer belt 78 is completed.

The sheet P conveyed through the secondary transfer nip is conveyed from a sheet feeder 12 disposed in a lower portion of the body of the image forming apparatus 1 through a feed roller 97, a registration roller pair 98 (e.g., a timing roller pair), and the like. Specifically, the sheet feeder 12 contains a stack of multiple sheets P such as sheets of paper stacked on one on another. As the feed roller 97 rotates counterclockwise in FIG. 1, the feed roller 97 feeds an uppermost sheet P in the sheet feeder 12 to a roller nip between the registration roller pair 98.

The registration roller pair 98 stops rotating temporarily, stopping the sheet P with a leading edge of the sheet P nipped in the roller nip between the registration roller pair 98. Subsequently; the registration roller pair 98 rotates to convey the sheet P to the secondary transfer nip, timed to coincide with the arrival of the color toner image on the intermediate transfer belt 78, and the secondary transfer roller 89 transfers the desired color toner image onto the sheet P.

After the secondary transfer roller 89 transfers the color image onto the sheet P at the secondary transfer nip, the sheet P is conveyed to a fixing device 20. In the fixing device 20, a fixing belt 21 and a pressure roller 31 apply heat and pressure to the sheet P to fix the transferred color toner image on the sheet P, which is referred to as a fixing process.

After the fixing process, the sheet P bearing the fixed toner image is conveyed through a roller nip formed by an output roller pair 99 and ejected by the output roller pair 99 onto an outside of the image forming apparatus 1. The sheets P ejected by the output roller pair 99 are sequentially stacked as output images on a stack section 100.

Thus, a series of image forming processes performed by the image forming apparatus 1 is completed.

Figure 2:
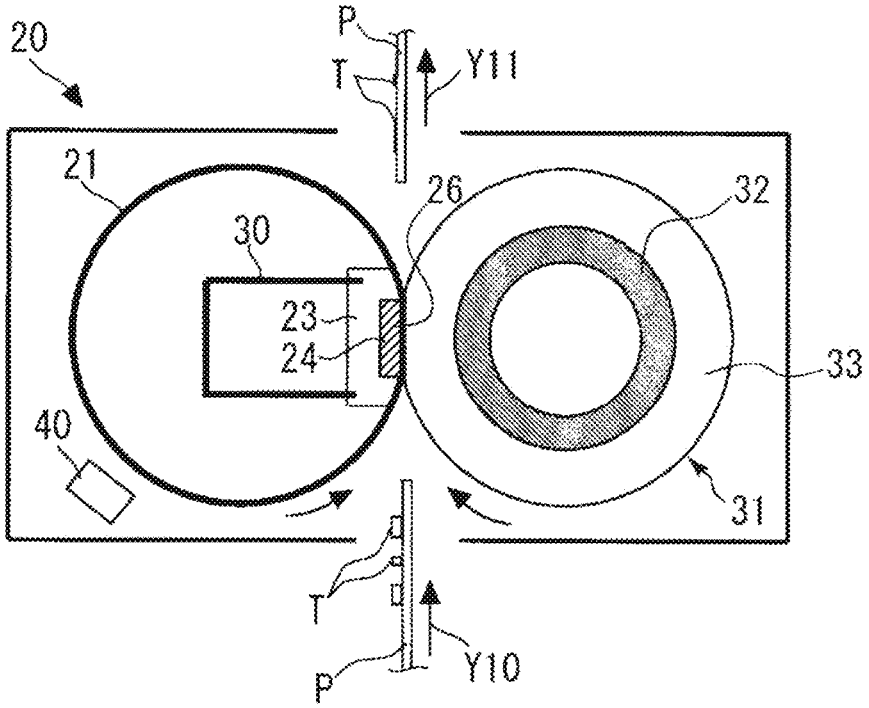
FIG. 2 is a schematic view of a configuration of a fixing device in the image forming apparatus of FIG. 1.
Figure 3:
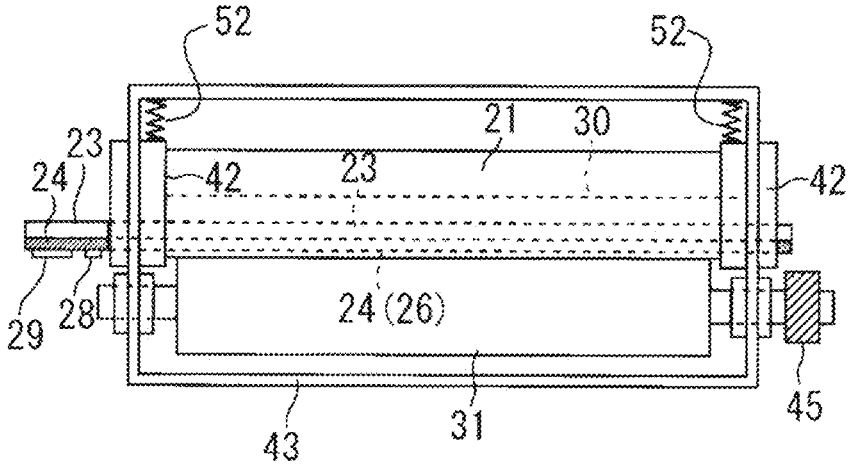
FIG. 3 is a top view of the fixing device illustrating a part extending in a width direction that is a lateral direction in FIG. 3.
Figure 4:
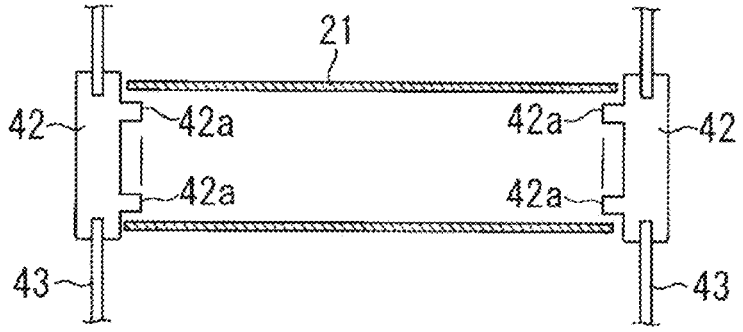
FIG. 4 is a schematic cross-sectional view of a fixing belt extending in the width direction and guides included in the fixing device of FIG. 3.

Referring to FIGS. 2 to 4, the following describes a configuration and operation of the fixing device 20 incorporated in the image forming apparatus 1 described above.

The fixing device 20 conveys the sheet P (bearing an unfixed toner image) while heating the sheet P. With reference to FIGS. 2 to 4, the fixing device 20 includes a fixing belt 21 serving as a fixing rotator, a reinforcement 30, a planar heater 24, a pressure roller 31 serving as a pressure rotator, and a temperature sensor 40 as a temperature detector. The fixing device 20 can be attached to and detached from the body of the image forming apparatus 1 by rotating an opening and closing cover 110 (see FIG. 1) on a hinge 110*a* in the body of the image forming apparatus 1.

The fixing belt 21 is an endless belt disposed in contact with an outer circumferential surface of the pressure roller 31 and driven to rotate by rotation of the pressure roller 31. The fixing belt 21 is a thin, flexible endless belt driven to rotate counterclockwise in FIG. 2, that is, in a rotation direction indicated by arrow in FIG. 2. The fixing belt 21 is constructed of a base layer serving as an inner circumferential surface (i.e., a sliding contact surface of the fixing belt 21 sliding over the planar heater 24), an elastic layer coating the base layer, and a release layer coating the elastic layer, which define a total thickness of the fixing belt 21 not greater than 1 mm.

The base layer of the fixing belt 21 has a thickness in a range of from 30 μm to 50 μm and is made of metal, such as nickel or stainless steel, or resin such as polyimide.

The elastic layer of the fixing belt 21 has a thickness of 100 μm to 300 μm and is made of rubber such as silicone rubber, foamable silicone rubber, or fluoro rubber. The elastic layer absorbs slight surface asperities of the fixing belt 21 at a fixing nip formed between the fixing belt 21 and the pressure roller 31, facilitating even heat conduction from the fixing belt 21 to the color toner image T on the sheet P and thereby suppressing formation of an orange peel image on the sheet P.

The release layer of the fixing belt 21 has a thickness in a range of from 5 μm to 50 μm and is made of material such as tetrafluoroethylene-perfluoroalkyl vinyl ether copolymer (PFA), polytetrafluoroethylene (PTFE), polyimide, polyether imide, and polyether sulfone (PES). The release layer facilitates separation or peeling-off of toner of the color toner image T on the sheet P from the fixing belt 21.

Inside a loop of the fixing belt 21, the planar heater 24, a holder 23 and the reinforcement 30 are disposed The planar heater 24 is disposed opposite the inner circumferential surface of the fixing belt 21. The planar heater 24 presses against the pressure roller 31 via the fixing belt 21 to form the fixing nip through which the sheet P is conveyed. The planar heater 24 is disposed inside the loop formed by the fixing belt 21 such that the inner circumferential surface of the fixing belt 21 slides over the planar heater 24. The planar heater 24 presses against the pressure roller 31 via the fixing belt 21 to form the fixing nip between the fixing belt 21 and the pressure roller 31, through which the sheet P is conveyed. As described above, the planar heater 24 functions as a nip formation pad that is a member forming the fixing nip. The planar heater 24 may include a surface layer or a sheet made of low friction material such as PTFE on the surface of the planar heater 24 to reduce sliding friction between the fixing belt 21 and the planar heater 24.

In addition, the planar heater 24 includes a resistor pattern 26 (see FIGS. 5 to 8B) formed on a portion that is in sliding contact with the inner circumferential surface of the fixing belt 21. A power supply supplies electric power to the resistor pattern 26 serving as a resistive heat generator, and the resistor pattern 26 generates heat according to the resistance of the resistor pattern 26 to heat the fixing belt 21. As described above, the planar heater 24 also functions as a heating unit (heating body) that heats the fixing belt 21.

In the present embodiment, the holder 23 holds the planar heater 24. As illustrated in FIG. 3, a housing 43 of the fixing device 20 holds both end portions of the holder 23 in a width direction of the holder 23 that is the direction perpendicular to a plane on which FIG. 2 is illustrated and the lateral direction in FIG. 3.

The planar heater 24 is described below in detail with reference to FIGS. 5 to 7, etc.

As described above, the planar heater 24 (the resistor pattern 26) disposed inside the loop of the fixing belt 21 directly heats the fixing belt 21. Heat is conducted from an outer circumferential surface of the fixing belt 21 heated by the planar heater 24 to the toner image T on the sheet P.

Output of the planar heater 24 is controlled based on the temperature of the outer circumferential surface of the fixing belt 21 detected by the temperature sensor 40. The temperature sensor 40 is a thermopile, a thermistor, or the like, disposed opposite the outer circumferential surface of the fixing belt 21. The Planar heater 24 controlled as described above heats the fixing belt 21 to a desired fixing temperature.

Referring to FIG. 4, a pair of flanges 42 as guides guide ends of the inner circumferential surface of the fixing belt 21 in a width direction of the fixing belt 21 such that the fixing belt 21 maintains a substantially cylindrical posture.

Specifically; the two flanges 42 are made of a heat-resistant resin material or the like and are fitted into both sides in the width direction of the housing 43 of the fixing device 20. Each of the flanges 42 includes a guide 42*a* and a stopper. The guide 42*a* supports the fixing belt 21 to maintain a substantially cylindrical posture thereof. The stopper restricts motion or skew of the fixing belt 21 in the width direction thereof.

In addition, as illustrated in FIG. 3, the fixing device 20 according to the present embodiment includes compression springs 52 as biasing members. Biasing force of the compression springs 52 press the flanges 42. As a result, the fixing belt 21, the planar heater 24, and the holder 23 are pressed against the pressure roller 31 by the biasing force.

The flanges 42 support both end portions of the fixing belt 21 in the width direction of the fixing belt 21 except for both end portions corresponding to the fixing nip so that the planar heater 24 can form the fixing nip.

As described above, the inner circumferential surface of the fixing belt 21 is loosely contacted only by the planar heater 24 and the flanges 42 at respective ends of the fixing belt 21 in the width direction thereof. No other component, such as a belt guide, contacts the inner circumferential surface of the fixing belt 21 to guide the fixing belt 21 as it rotates.

The fixing device 20 according to the present embodiment includes the reinforcement 30 that is disposed inside the loop of the fixing belt 21 so as to be in contact with the pressure roller 31 via the holder 23, the planar heater 24, and the fixing belt 21. The reinforcement 30 reinforces the holder 23 and the planar heater 24 forming the fixing nip, enhancing the mechanical strength of the holder 23 and the planar heater 24. The reinforcement 30 is installed in the housing 43 by screw fastening or the like.

The reinforcement 30 receiving the pressure from the pressure roller 31 via the holder 23, the planar heater 24, and the fixing belt 21 prevents a disadvantage that the pressure from the pressure roller 31 largely deforms the planar heater 24 (and the holder 23) at the fixing nip. Preferably, the reinforcement 30 is made of metal having an increased mechanical strength, such as stainless steel or iron, to ensure the above-described function. The holder 23 may be made of a resin material or a metallic material. Preferably, the holder 23 is made of a resin material that has a rigidity great enough to prevent substantial bending even if the holder 23 receives the pressure from the pressure roller 31 and has heat resistance and thermal insulation, such as liquid crystal polymer (LCP), polyamide imide (PAI), polyether sulfone (PES), polyphenylene sulfide (PPS), polyether nitrile (PEN), and polyether ether ketone (PEEK). In the present embodiment, the holder 23 is made of LCP.

Referring to FIG. 2, the pressure roller 31 as the pressure rotator includes a cored bar 32 (serving as an axial portion) and an elastic layer 33 coating the cored bar 32. The pressure roller 31 is driven and rotated clockwise in FIG. 2 by a drive motor.

The cored bar 32 of the pressure roller 31 is a hollow structure made of a metallic material. The elastic layer 33 of the pressure roller 31 is made of material such as foamable silicone rubber, silicone rubber, or fluoro rubber. A thin release layer made of PFA, PTFE or the like may be provided on the surface of the elastic layer 33. The pressure roller 31 is pressed against the fixing belt 21 to form a desired nip between the fixing belt 21 and the pressure roller 31. As illustrated in FIG. 3, a gear 45 is attached to the pressure roller 31 and engages a driving gear of the drive motor so that the pressure roller 31 is driven and rotated clockwise in FIG. 2, that is, a direction indicated by arrow in FIG. 2. Both ends of the pressure roller 31 in the width direction of the pressure roller 31 are rotatably supported by the housing 43 of the fixing device 20 through bearings, respectively.

A description is provided of a regular fixing process to fix the toner image T on the sheet P, which is performed by the fixing device 20 having the construction described above.

As the body of the image forming apparatus 1 is powered on, power is supplied to the heater 24 and the motor, and the motor starts driving and rotating the pressure roller 31 clockwise in FIG. 2, that is, in the direction indicated by arrow in FIG. 2. Accordingly, the pressure roller 31 drives and rotates the fixing belt 21 counterclockwise in FIG. 2 by friction therebetween generated at the fixing nip N.

Thereafter, the sheet P is fed from the sheet feeder 12, the color toner image is transferred onto the sheet P at the position of the secondary transfer roller 89 and becomes the unfixed color toner image T borne on the sheet P. As illustrated in FIG. 2, the sheet P bearing the unfixed color toner image T is conveyed in a direction indicated by arrow Y10 while the sheet P is guided by a guide plate and enters the fixing nip formed between the fixing belt 21 and the pressure roller 31 pressed against the fixing belt 21.

The toner image T is fixed on a surface of the sheet P under heat from the fixing belt 21 heated by the planar heater 24 and pressure exerted from the planar heater 24 (and the holder 23) and the pressure roller 31 pressed against the planar heater 24 supported by the reinforcement 30. Thereafter, the sheet P is ejected from the fixing nip and conveyed in a direction Y11.

A description is provided of a configuration and an operation of the planar heater 24 (the fixing device 20) in detail.

The planar heater 24 in the present embodiment includes a base 25, the resistor patterns 26 (the resistive heat generators), conductor patterns 27 (relay portions), power supply electrodes 28 (terminal portions), a base pattern 29 (an identification information printed portion), and the like.

At least a surface portion of the base 25 (the surface portion facing the inner circumferential surface of the fixing belt 21 at the fixing nip) is made of an insulative material. In the present embodiment, the base 25 is entirely made of the insulative material (aluminum nitride (AlN) in the present embodiment). Aluminum nitride is a dark color material and is not suitable for printing identification information with good visibility.

The resistor patterns 26 are formed on the surface of the base 25. Similarly, the conductor pattern 27 is also formed on the surface of the base 25.

A current flows through the resistor pattern 26 (that is, energizing the resistor pattern 26), the resistance of the resistor pattern 26 generates heat, and the resistor pattern 26 functions as the resistive heat generator. The resistor pattern 26 is formed by applying and screen-printing a paste prepared to have a desired resistance value to the surface of the base 25 and baking the paste after screen-printing.

Each of the conductor patterns 27 electrically couples between the resistor patterns 26 or between the resistor pattern 26 and the power supply electrode 28 to function as the relay portion that flows the current input from the power supply electrode 28 to the resistor pattern 26. The conductor pattern 27 is formed by applying and screen-printing a paste having high conductivity to the surface of the base 25 and baking the paste after screen-printing.

Figure 7:
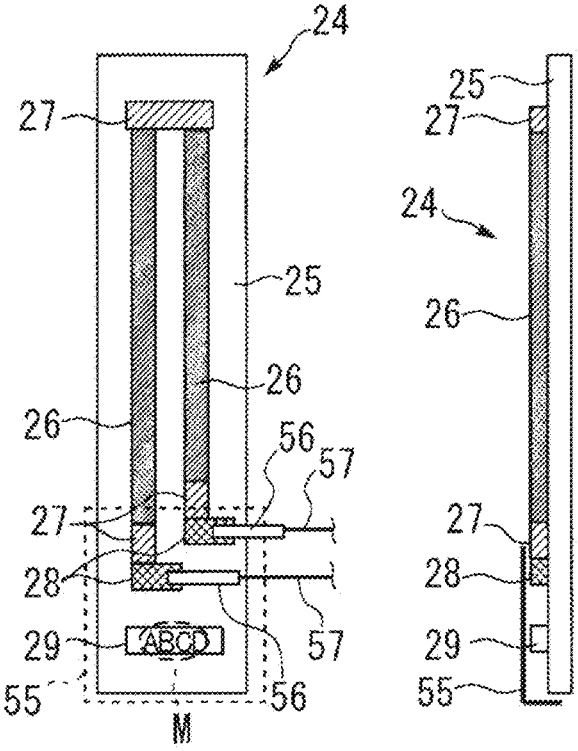
FIG. 7 is a schematic top view and a schematic side view of the planar heater of FIG. 5 coupled to the fixing device.

The power supply electrode 28 is electrically coupled to the conductor pattern 27 and is formed to be able to couple to an external terminal 56 (see FIG. 7). Accordingly, even when the surface layer having electrical insulating property and low friction property is formed on the entire surface of the planar heater 24, a part of the surface layer over the power supply electrode 28 is removed to expose the power supply electrode 28 and supply power to the power supply electrode 28.

The power supply electrode 28 is made of a silver-based material such as silver (Ag) or silver palladium (AgPd) in order to reduce heat generation due to energization. In the present embodiment, the power supply electrode 28 is formed by screen-printing the material on the surface of the base 25 and baking the material after screen-printing.

The base pattern 29 is made of a material different from a material of the surface of the base 25. In the present embodiment, the base pattern 29 is formed of a material other than aluminum nitride, for example, the silver-based material of the power supply electrode 28. The base pattern 29 is formed on the surface of the base 25 to print visible identification information M (see FIGS. 5 and 7). Specifically, in the present embodiment, the base pattern 29 is formed by screen-printing a material having white or a color close to white on the surface of the base 25 and baking after screen-printing.

The identification information M printed on the base pattern 29 is information for specifying (identifying) characteristics and the like of the manufactured planar heater 24.

Since screen-printing and other factors vary resistance values of the resistor patterns 26 of the planar heaters 24 produced, all or a part of resistance values of the planar heaters 24 are measured, and each resistance value or a resistance value in each manufacturing lot is managed.

In addition, the planar heaters 24 in the fixing device 20 (the image forming apparatus 1) is used in each destination country using a working voltage different in each country. Therefore, different types of planar heaters 24 are used.

As a result, in order to associate the above-described information such as the working voltage, the manufacturing lot, and the resistance value with each of the planar heaters 24 and manage the planar heaters 24 produced, it is desired to mark the identification information NI capable of identifying the above-described information on the planar heater 24 with high visibility.

In the present embodiment, the white base pattern 29 is formed on the base 25 made of a dark color material, and the identification information M is printed on the white base pattern 29 with dark color ink such as black.

The above-described configuration improves the visibility of the identification information M for identifying the manufacturing lot, resistance characteristics, or the like of the planar heater 24. As a result, the above-described configuration enables a simple inspection without mistake performed by not only a human but also an automatic inspection device such as a camera in a manufacturing process of the planar heater 24 itself, a process of assembling the planar heater 24 to the fixing device 20, and the like, which provides stable high quality of the planar heater 24 and the fixing device 20.

After the planar heater 24 is manufactured and measured for the resistance value characteristics or the like, the identification information M may be printed by an inkjet printer or the like on the basis of the measured results.

In particular, with reference to FIG. 3, the identification information NI of the planar heater 24 is easily visually recognized even after the planar heater 24 is assembled to the fixing device 20 (or a subunit modularized with the fixing belt 21 and the like). As a result, the camera or the like can automatically recognize the identification information NI in an inspection process of the fixing device 20 (or the subunit) in which the planar heater 24 is assembled, and the recognized identification information NI can be stored by a memory disposed in the fixing device 20 (or the subunit) or set by a dip switch disposed in the fixing device 20 (or the subunit).

In the present embodiment, the power supply electrode 28 and the base pattern 29 in the planar heater 24 are made of the same silver-based material. The above-described configuration enables forming the power supply electrode 28 and the base pattern 29 on the base 25 at the same time and reduces the number of screen masks necessary for screen printing and the number of steps required for printing and baking, thereby reducing the manufacturing time and cost.

In addition, the power supply electrode 28 and the base pattern 29 in the planar heater 24 are not electrically connected to each other. The above-described configuration does not cause a disadvantage that a current to be supplied to the resistor pattern 26 via the power supply electrode 28 wastefully flows to the base pattern 29.

Figure 5:
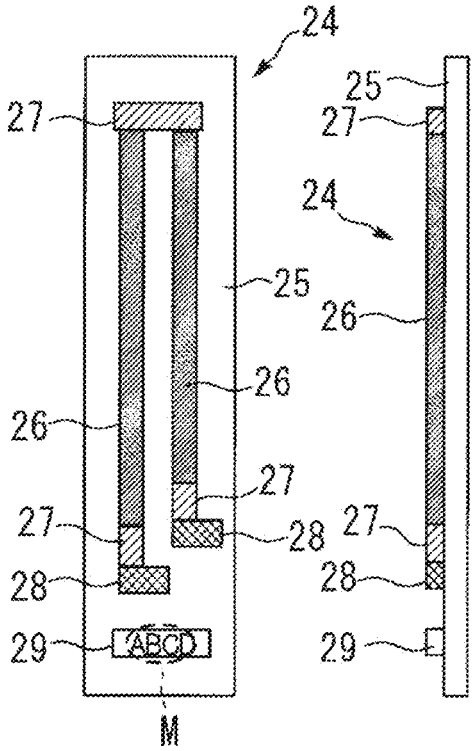
FIG. 5 is a schematic top view and a schematic side view of a planar heater according to an embodiment of the present disclosure.

As illustrated in FIG. 5, both the power supply electrodes 28 and the base pattern 29 in the planar heater 24 according to the present embodiment are disposed on one end portion of the base 25 in the width direction of the planar heater 24 (that is one end portion of the base 25 in the longitudinal direction of the planar heater 24, the lower portion of the base 25 illustrated in FIG. 5, and the left portion of the base 25 of the planar heater 24 illustrated in FIG. 3).

Referring to FIG. 3, The above-described configuration associates a work for coupling the external terminals 56 (see FIG. 7) from the outside to the power supply electrodes 28 with a work for visually recognizing the identification information M printed on the base pattern 29 in the planar heater 24 attached to the fixing device 20. That is, since the power supply electrodes 28 and the base pattern 29 are formed on the same portion of the base 25, a worker can perform the work for coupling the external terminals 56 (see FIG. 7) to the power supply electrodes 28 while checking the identification information M.

As described above with reference to FIG. 3 and the like, the housing 43 disposed in the fixing device 20 according to the present embodiment holds both end portions of the holder 23 in the width direction of the holder 23 holding the planar heater 24 and both ends of the fixing belt 21 in the width direction of the fixing belt 21 via the pair of flanges 42.

The planar heater 24 in the present embodiment is set such that the base pattern 29 and the power supply electrodes 28 are outside the housing 43 in the width direction of the housing 43 as illustrated in FIG. 3. The above-described "the base pattern 29 and the power supply electrodes 28 are outside the housing 43 in the width direction of the housing 43" means that the base pattern 29 and the power supply electrodes 28 are at visible positions after the housing 43 is assembled to form the fixing device 20.

According to the above-described configuration, the worker easily and visually recognize the identification information M printed on the base pattern 29 from the outside and easily couples the external terminals 56 (see FIG. 7) to the power supply electrodes 28 from the outside.

In addition, as illustrated in FIG. 3, the base pattern 29 and the power supply electrodes 28 in the present embodiment are disposed on a non-driving side of the fixing device 20 (that is the side on which the gear 45 is not disposed). The above-described configuration prevents a disadvantage that a member disposed on a driving side of the fixing device 20 prevents the worker from visually recognizing the identification information M and a disadvantage that the gear winds in a harnesses 57 (see FIG. 7) for power supply.

As illustrated in FIG. 7, the planar heater 24 according to the present embodiment includes a cover 55 covering the power supply electrodes 28 and the base pattern 29 on which the identification information M is printed.

As described above, the base pattern 29 and the power supply electrode 28 are formed of a silver-based material that is easily corroded. In order to prevent a decrease in visibility of the identification information M due to corrosion and a power supply failure due to corrosion, the cover 55 made of a heat resistant resin such as PPS or PAI covers the base pattern 29 (the identification information M) and the power supply electrodes 28.

The planar heater 24 is held by the holder 23 made of LCP or the like and assembled as a unit in the fixing device 20, and the external terminals 56 are coupled to the power supply electrodes 28. The power supply is installed in the image forming apparatus 1 and supplies the electric power to the power supply electrodes 28 (that is, the planar heater 24) via the harnesses 57 (that are AC harnesses) and external terminals 56.

The planar heater 24 according to the present embodiment is manufactured by a manufacturing method including the following process.

Figure 6A:
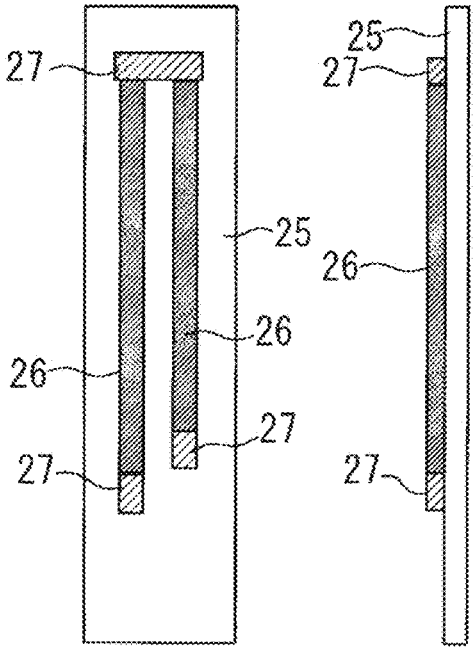
FIGS. 6A and 6B are schematic top views and schematic side views to illustrate a manufacturing processes of the planar heater according to the embodiment.

(1) A process forming the resistor pattern 26 and a conductor pattern 27 electrically connected to the resistor pattern 26 on the surface of the base 25 at least the surface portion of which is made of an insulative material (see FIG. 6A).

Figure 6B:
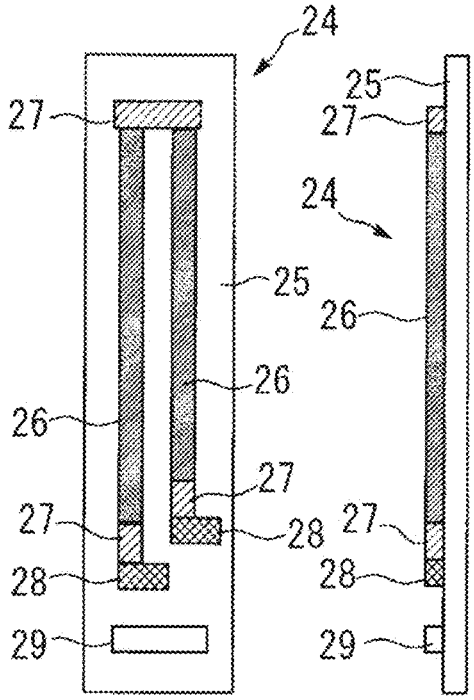

(2) A process forming the power supply electrodes 28 and the base pattern 29 on the surface of the base 25 (see FIG. 6B). The power supply electrodes 28 are electrically coupled to the conductor pattern 27. The base pattern 29 is made of the material different from the material of the surface portion of the base 25, and the visible identification information M is printed on the base pattern 29.

The above-described processes may be performed in an order different from the one described above.

After these processes are performed, a process forming an insulation layer, a low friction layer, or the like on the surface of the planar heater 24 other than the surface of the power supply electrodes 28 may be performed. In order to expose the power supply electrodes 28, the power supply electrodes 28 may be masked during the above process.

Next, a variation of the present embodiment is described.

Figure 8A:
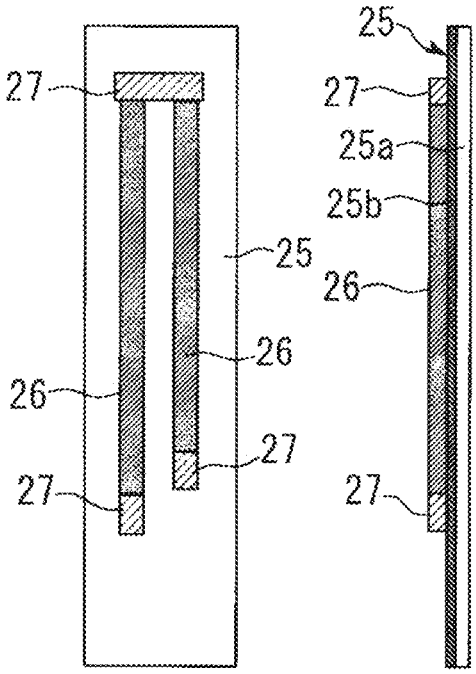
FIGS. 8A and 8B are schematic top views and schematic side views to illustrate a manufacturing process of the planar heater according to a variation.
Figure 8B:
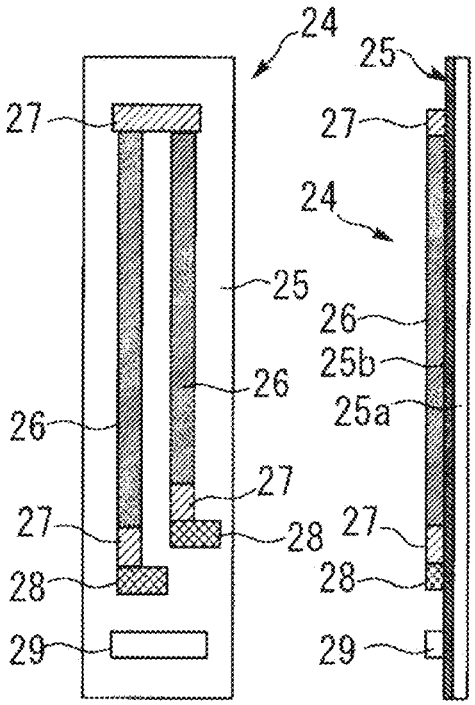

As illustrated in FIGS. 8A and 8B, the planar heater 24 according to the variation includes the base 25 including a main base 25*a* and an insulation layer 25*b*. The main base 25*a* is made of a conductive material such as stainless steel. The insulation layer is made of glass or the like and formed on the main base 25*a*.

Even if the identification information NI is directly printed on the surfaces of the insulation layer 25*b* made of transparent glass with dark color ink, the visibility of the identification information M is not good because the baked stainless steel of the main base 25*a* has a dark color.

Similar to the above-described embodiment, the planar heater 24 includes the white-based base pattern 29 formed on the base 25 (that is, the insulation layer 25*b*), and the identification information M is printed on the white-based base pattern 29 with dark color ink such as black ink.

The above-described configuration improves the visibility of the identification information M for identifying the manufacturing lot, resistance characteristics, or the like of the planar heater 24.

Instead of the dark color ink, the identification information M may be printed on the base pattern 29 with ink having a color different from the color of the base pattern 29. In order to visually recognize the identification information M, the base pattern 29 may be screen-printed except for the position of the identification information M.

As described above, the planar heater 24 according to the present embodiment includes the base 25 having at least the surface portion made of the insulative material, the resistor pattern 26 formed on the surface of the base 25, the conductor pattern 27 formed on the surface of the base 25 and electrically coupled to the resistor pattern 26, and the power supply electrode 28 electrically coupled to the conductor pattern 27. In addition, the planar heater 24 includes the base pattern 29 formed on the surface of the base 25 and made of the material different from the material of the surface portion of the base 25 for printing the visible identification information M.

As a result, the identification information M on the planar heater 24 is easily visually recognized.

In order to improve maintainability of the planar heater 24 and the fixing belt 21 in the fixing device 20 according to the present embodiment, a subunit may be configured. The subunit may include the planar heater 24, the fixing belt 21, the flanges 42, the compression springs 52, a part of the housing 43, and the like and may be configured to be attachable to and detachable from the fixing device 20.

Although the planar heater 24 in the present embodiment includes the base pattern 29 and the power supply electrodes 28 that are disposed on one end portion of the base 25 in the width direction of the base 25, the planar heater 24 may include the base pattern 29 on one end portion of the base 25 in the width direction and the power supply electrodes 28 on the other end portion of the base 25 in the width direction. In such a case, insulation between the base pattern 29 and the power supply electrodes 28 can be easily ensured.

Although the planar heater 24 according to the present embodiment is installed in the fixing device 20, the device in which the planar heater 24 is installed is not limited to this.

In such a configuration, similar effects to those of the above-described embodiment and variation are also attained.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. The number, position, and shape of the components described above are not limited to those embodiments described above. Desirable number, position, and shape can be determined to perform the present disclosure.

In the present disclosure, the width direction defines a direction being perpendicular to a direction of conveying the sheet P and parallel to the axial direction of the fixing belt 21 and the pressure roller 31.

What is claimed is:

1. A planar heater comprising:

a base including a surface portion made of an insulative material;

a resistor pattern on the base;

a conductor pattern being on the base and electrically coupled to the resistor pattern;

a power supply electrode electrically coupled to the conductor pattern; and a base pattern being on the base and made of a material different from a material of the surface portion of the base, the base pattern including visible identification information, wherein the base pattern is screen-printed on the base, and the identification information is printed on the base pattern with ink having a color different from a color of the base pattern.

2. The planar heater according to claim 1, wherein the power supply electrode and the base pattern are made of same silver-based material and are not electrically connected to each other.

3. The planar heater according to claim 1, wherein the power supply electrode and the base pattern are on one end portion of the base in a width direction of the base.

4. The planar heater according to claim 1, further comprising:

a cover configured to cover the base pattern on which the identification information is printed.

5. The planar heater according to claim 1, wherein the base is made of the insulative material.

6. The planar heater according to claim 1, wherein the base includes:

a main base made of a conductive material; and an insulation layer on the main base.

7. A fixing device comprising:

a planar heater including, a base including a surface portion made of an insulative material, a resistor pattern on the base, a conductor pattern being on the base and electrically coupled to the resistor pattern, a power supply electrode electrically coupled to the conductor pattern, and a base pattern being on the base and made of a material different from a material of the surface portion of the base, the base pattern including visible identification information;

a fixing belt configured to be heated by the planar heater; and a pressure rotator configured to press the planar heater via the fixing belt.

8. The fixing device according to claim 7, further comprising:

a holder configured to hold the planar heater;

a pair of flanges configured to support both ends of the fixing belt in a width direction of the fixing belt; and a housing configured to hold the pair of flanges and both ends of the holder in a width direction of the holder, wherein the base pattern of the planar heater is at a position outside the housing in a width direction of the housing.

9. The fixing device according to claim 8, wherein the position outside the housing in the width direction is visible from outside the fixing device.

10. An image forming apparatus comprising the fixing device according to claim 7.

11. The fixing device according to claim 7, wherein the base pattern is screen-printed on the base; and the identification information is printed on the base pattern with ink having a color different from a color of the base pattern.

12. The fixing device according to claim 7, wherein the power supply electrode and the base pattern are made of same silver-based material and are not electrically connected to each other.

13. The fixing device according to claim 7, wherein the power supply electrode and the base pattern are on one end portion of the base in a width direction of the base.

14. The fixing device according to claim 7, further comprising:

a cover configured to cover the base pattern on which the identification information is printed.

15. The fixing device according to claim 7, wherein the base is made of the insulative material.

16. The fixing device according to claim 7, wherein the base includes:

a main base made of a conductive material; and an insulation layer on the main base.

17. A method of manufacturing a planar heater, comprising:

forming a resistor pattern and a conductor pattern electrically connected to the resistor pattern on a base including a surface portion made of an insulative material; and forming, on the base, a power supply electrode electrically coupled to the conductor pattern and a base pattern made of a material different from a material of the surface portion of the base, the base pattern including visible identification information.

18. The method according to claim 17, further comprising:

screen-printing the base pattern on the base; and printing the identification information on the base pattern with ink having a color different from a color of the base pattern.

19. The method according to claim 17, further comprising:

forming the base using the insulative material.

20. The method according to claim 17, wherein the power supply electrode and the base pattern are formed using a same silver-based material and are not electrically connected to each other.

* * * * *